United States Patent [19]

Hitzler

[11] Patent Number: 4,919,295

[45] Date of Patent: Apr. 24, 1990

[54] MULTI-CELL DRINK CONTAINER

[76] Inventor: Terry Hitzler, 850 Saylor, Elmhurst, Ill. 60126

[21] Appl. No.: 396,309

[22] Filed: Aug. 21, 1989

[51] Int. Cl.[5] ..... B65D 21/00

[52] U.S. Cl. ..... 220/23.83; 220/1 BC

[58] Field of Search ..... 220/23.4, 23.83, 23.86, 220/1 BC, 21

[56] References Cited

U.S. PATENT DOCUMENTS

| | | | |
|---|---|---|---|
| 1,768,976 | 7/1930 | Cuthbertson | 220/23.4 X |
| 2,048,572 | 7/1936 | Smith | 220/23.4 X |
| 2,327,077 | 8/1943 | Teetor | 220/23.86 |
| 2,799,427 | 7/1957 | Shekter | 220/23.83 |
| 4,491,219 | 1/1985 | Lutz | 220/23.86 X |

*Primary Examiner*—Steven M. Pollard

*Attorney, Agent, or Firm*—Paul H. Gallagher

[57] ABSTRACT

A cylindrical can having an originally open top, and a cup-shaped insert therein. The insert is of lesser volume than the can, and has an open top. The insert is positioned with its open top essentially in the same plane with the open top of the can, and cover means is applied to the can, sealing the can and the insert. The cover means includes two separate elements, one sealing the insert and the other sealing the can relative to the space surrounding the insert. An openable closure member is incorporated in each of the elements of the closure means.

8 Claims, 1 Drawing Sheet

MULTI-CELL DRINK CONTAINER

BRIEF SUMMARY OF THE INVENTION

The invention relates to containers for what are collectively known as drinks. Such drinks may be soft drinks or pop, or non-alcoholic drinks, and they also include alcoholic drinks. Such drinks, and particularly soft drinks, are quite often provided in cans, and at times also alcoholic drinks are provided in cans.

The present invention is directed to such containers in the form of cans, and a principal feature is that the container has an outward appearance very similar to containers that are now popularly known, but includes a plurality of cells for holding drinks of different kinds.

Another feature is that the container, in the construction and fabrication thereof, utilizes a main part of the kind now used in making containers of known kind, with small additions thereto.

Still another feature is that the cells can be of different sizes so as to accommodate drinks of different kinds, an example of which is a small cell for holding an alcoholic drink and a large cell for holding a non-alcoholic counterpart often known as a mix.

BRIEF DESCRIPTION OF THE SEVERAL VIEWS OF DRAWING

DETAILED DESCRIPTION

Figure 1:
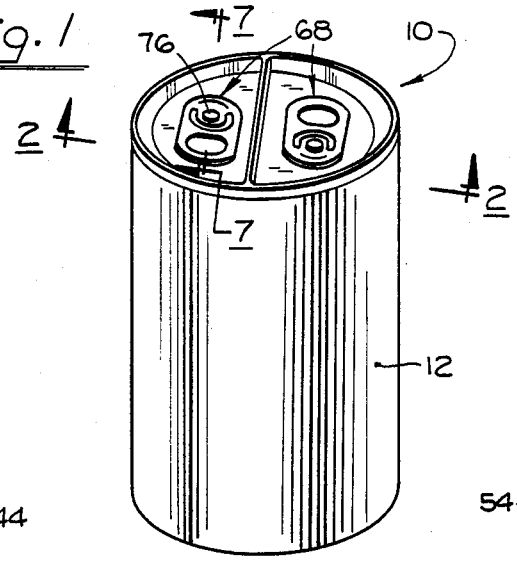
FIG. 1 is a perspective view of a container made according to the present invention.
Figure 2:
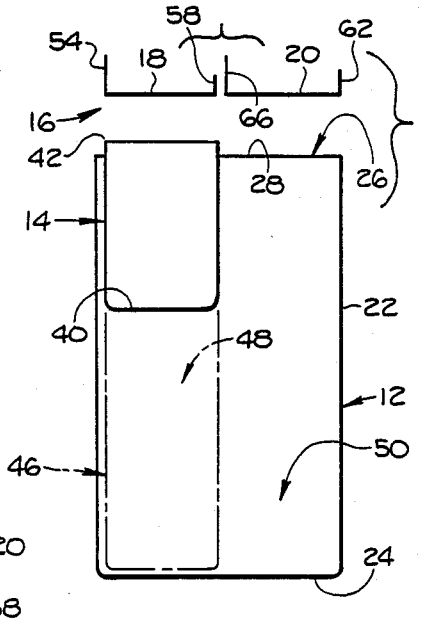
FIG. 2 is a semi diagrammatic view of the container oriented according to section line 2—2 of FIG. 1, and shown partially exploded.

FIG. 1 shows a container 10 in perspective view, incorporating the features of the invention. Reference is made to FIG. 2 in conjunction with FIG. 1 for identifying the parts of the container. The container includes a can 12, an insert 14, and cover means 16 made up of parts 18, 20.

The can itself (FIG. 2) is a known item and includes a cylindrical wall 22 and a bottom element 24, and it has an open top indicated at 26. The can terminates in an upwardly extending edge 28 which is of course circular, and is continuous, surrounding the open top 26.

The can may be made in any suitable manner, such as by extrusion, and it is pointed out that in the case of such cans heretofore known, commonly used for soft drinks, the can is seamless, and it is closed by a cover means that is crimped to the upper edge of the can which forms a bead sealing the interior. This crimping action forming a bead is utilized in the present case, but in different forms, adapted to the particular characteristics of the elements incorporated in the container for forming the plurality of cells.

Figure 3:
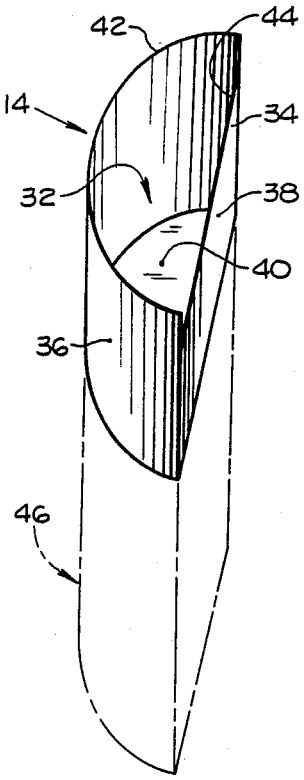
FIG. 3 is a perspective view of an insert of the container.
Figure 4:
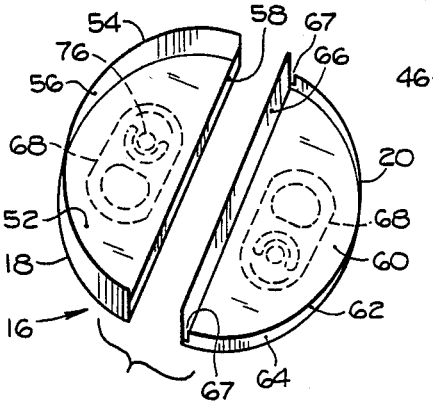
FIG. 4 is a perspective view of the cover means.

The insert 14 is shown in perspective in FIG. 4 and is cup-shaped, having an interior space 32. It includes a surrounding wall 34 which includes a circular portion 36 which in the specific instance is a half circle, and a straight portion 38 forming a chord to the circular shape, and in this instance the insert is dimensioned so that the straight portion or chord 38 lies approximately in a diameter of the can. The insert includes a bottom element 40, and the wall 34 terminates in an upwardly extending edge which includes a circular portion 42 and a straight portion 44, the portion 42 being higher than the portion 44. FIG. 3 shows the insert, in solid lines, of a length, or depth, less than the depth of the can, while at the lower part is a dot dash line extension 46 indicating a longer or deeper insert. The shorter insert is shown in FIG. 2, this being substantially shorter than the depth of the can and thus is spaced from the bottom of the can a substantial distance as indicated at 48 (FIG. 2), while a longer or deeper insert, indicated at 46, extends substantially to the bottom of the can and may actually rest thereon. When the insert is positioned in the can, as shown in FIG. 2, a second space, indicated at 50, is formed, forming a separate cell in the completed container. The space 50 may actually surround the insert, that is, the curved wall 36 need not be sealed to the cylindrical wall of the can.

The cover means 16, referred to above, is shown in perspective in FIG. 4, and each of the parts 18, 20, is of shallow pan-shape; the part 18 includes a bottom element 52 and a surrounding edge element 54 made up of a circular portion 56 and a straight portion 58. The circular portion 56 is of relatively greater height, or vertical extent, and the straight portion 58 of relatively lesser height. The part 20 has a floor element 60 and a surrounding edge element 62 which includes a circular portion 64 and a straight portion 66. The portion 64 is of a height less than the straight portion 66, and the latter is of a height greater than the portion 58, for crimping purposes as will be explained hereinbelow. These edge portions, in an early fabricating step, extend upwardly, but in the completed container, they are crimped over the upper edges of the can and the insert.

Figure 5:
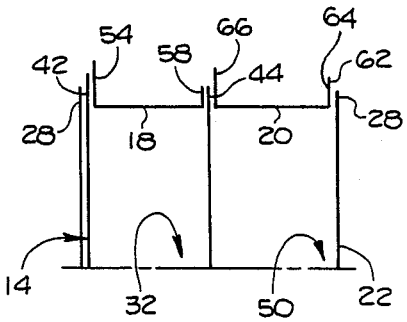
FIG. 5 is a view oriented according to FIG. 2, showing the cover means in position for securement to the can.
Figure 6:
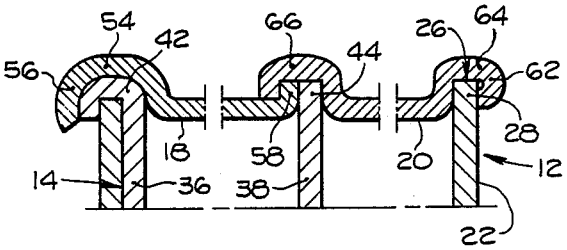
FIG. 6 is a large detail sectional view oriented according to FIG. 5, and of exaggerated form.

The two parts 18, 20, of the cover means, when fitted together with the straight portions adjacent each other, form substantially a circle, and they are inserted in the upper end of the can, in association with the insert 14 being positioned in the can as represented in FIG. 2. At this step of the operation the edge 42 of the insert may be bent into the shape shown in FIG. 6, to form a hook of that edge that can be hooked over the edge of the can, to locate the insert in the can. In a later step, this hook is crimped in finalizing the assembling of the container. In so applying or affixing the cover means to the can, the parts are so inserted in the upper end of the can, the part 18 being inserted into the upper open end of the insert, and the part 20 being inserted directly in the can, beside the insert, and fitted down into the can to a position represented in FIG. 5 where the edge portions of the cover means extend above the upwardly extending edge of the can. After the cover means is so positioned, the edge portions of the cover means are bent over and crimped on the corresponding edges of the can and insert as represented in FIG. 6. In FIGS. 5 and 6 the edge elements are individually identified for convenience in analysis thereof.

As the edge portions of the cover parts are crimped over the corresponding edges of the can and insert, they form beads as illustrated in FIG. 6, completely sealing the interior of the container. This crimping action and bead forming action is of known kind. As stated above, the edge portion 66 (FIG. 4) is higher than the mated edge portions 58 so that the former can be bent over the latter, and sealing the latter with the edge portion 44 of the insert. It is pointed out that the straight edge portion, at the ends thereof, has sufficient area, or body, to be worked into the corners formed by other elements in the container, and crimped there, so as to entirely seal the interior of the container at those points, as will be understood. Notches may be provided at the Junctures between the straight portion 66 and the circular portion 64, as at 67, if necessary or desired, to facilitate working the straight portion into sealing position.

Figure 7:
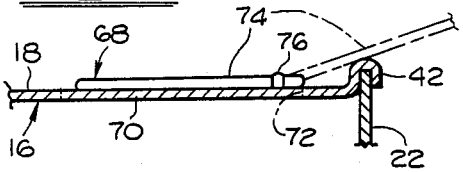
FIG. 7 is a sectional view taken approximately at line 7—7 of FIG. 1.

The container thus far described, forms two cells, one by the insert 14 and the other by the space 50 surrounding the insert, and reference is now made to openable closure means which close the two cells. This closure means is indicated at 68 and includes two identical means, one related to each of the cells, and they may be oppositely arranged. Each openable means, in itself is of known kind, but its incorporation in the present arrangement constitutes a new combination. Attention is directed to FIG. 7 which shows a portion of the part 18 of the cover means, in which the edge 42, forming a bead, is shown, crimped on the wall 22 of the can.

The part 18 includes a fracturable element 70, as indicated by the dot dash lines 72, forming a weakened or scored line, and a manual pull tab 74 mounted on a stud 76, the latter being in the cover part 18.

The pull tab 74 is swingable about the axis of the stud 76 between an inactive position shown in full lines and an active position shown in dot-dash lines. The construction enables a full size openable closure member 68 to be provided for each of the cells, the arrangement taking into consideration the fact that the openable member is relatively large, and the cells are relatively small compared with the overall size of the can.

When the container is to be stored, the pull tab is moved to its inactive portion, which is within the projection of the cylindrical wall, and when the container is to be opened, the pull tab is moved to its active position in which it extends beyond the cylindrical wall, but after opening the can, the requirement of convenience for having the pull tab within the confines of the cylindrical wall no longer exists.

The container thus provides a plurality of cells in which different kinds of drinks can be held. A very common size of can now on the market and well known, is of 12 ounce capacity, but that amount of drink for a small child is often excessive. Cans of lesser capacity are not popular, despite the fact that sometimes larger cans are not the most desired, but in the present case, a larger can, such as the 12 ounce can, will provide, for example, two cells each of 6 ounces, and in using the can, one of the cells can be opened for providing the drink desired for a small child. The other cell need not be opened at that time, and the drink in that cell can be preserved for a later time.

Another advantage of the container of the invention is that different kinds of drink may be put in the separate cells, with the corresponding convenience in selection of the kind of drink.

While the container of the kind Just described, may be desired for soft drinks, it may be desired to provide what is known as a mixed drink including an alcoholic drink and a non-alcoholic mixture therefor, commonly known as a mix. For the latter purpose, the short or shallow insert 14 shown in full lines in FIG. 3 may be utilized. In this case the insert is substantially less than half of the total capacity of the container, and an alcoholic drink may be placed in the small container, and a non-alcoholic mix in the large space 50. When it is desired to consume the contents of such a container, the insert side of the container is first opened, and the alcoholic drink is emptied into a glass, and then the other side opened, and the mix is poured into the glass in the desired amount, such as only a portion of the mix, or all of it.

While it has been stated that the space 50 is in surrounding relation to the insert, the significance of this is that the insert need not be fixed to the wall of the container, other than in the crimping step, and it is not objectionable that there be a space, even of capillary dimension, between the insert and the wall of the can. In connection with this relationship, it is pointed out that the container does not involve or necessitate the use of materials not already known in the can making art. The insert may be made of the same material as the can is, e.g. metal, and no special treatment is necessary with either the insert or the can, and the crimping action in applying the cover means, forms beads that are entirely sealed without any danger of contaminating the contents, or permitting leaking.

I claim:

1. A multi-cell container comprising, a cylindrical can having an originally open top, a cup shaped insert in the can, and having an open top and being otherwise continuous, the insert defining a first space for holding a liquid, and the can defining a second space surrounding the insert, also for holding a liquid, means mounting the insert in the container with the open top of the insert essentially in the same plane with the open top of the can, and cover means secured to the can sealingly closing both said spaces and including separate openable closure members operably associated with respective said spaces.

2. A multi-cell container according to claim 1 wherein, the can and the insert each has an upwardly extending edge surrounding its open top, and the cover means has edge portions crimped over the surrounding edges forming beads sealing said spaces.

3. A multi-cell container according to claim 2 wherein, the upstanding edge on the can is circular, the upstanding edge on the insert includes a circular portion and a straight portion forming a chord, the cover means includes separate elements, one closing the first space and the other closing the second space, the elements of the cover means including circular edge portins crimped over the circular edges as stated, one of the elements of the cover means also has a straight upturned edge adjacent said chord, and the container including a crimping strip crimped over the adjacent straight upturned edges, and thereby forming a bead sealing the interior of the container, at that location.

4. A multi-cell container according to claim 3 wherein, a portion of the upstanding edge of the insert is dimensioned and positioned, when the insert is in position in the can, as to be capable of being formed into a hook for engaging the edge of the can for positioning the insert in the can.

5. A multi-cell container according to claim 1 wherein, each openable closure member includes a fracturable portion and a pivot stud adjacent an end of the fracturable, and a pull tab mounted on the pivot stud, operable upon manual actuation thereof for fracturing the fracturable portion for forming an opening to the interior, the pull tab being swingable to an inactive position over the fracturable portion and within the circumfreence of the can, and an active position extending beyond the circumference of the can.

6. A multi-cell container according to claim 1 wherein, the insert is short relative to the length of the can, and thereby when mounted in the can being spaced from the bottom of the can.

7. A multi-cell container according to claim 1 wherein, the insert is of such length as to reach to the bottom of the can.

8. A plurality of multi-cell containers according to claim 1 wherein, in certain of the containers, the inserts are short relative to the length of the can, and thereby spaced from the bottom of the can, and thereby when mounted in the cans are spaced from the bottom of the cans, and in certain of the containers the inserts are of such length as to reach to the bottom of the can.

* * * * *